US006874266B1

(12) United States Patent
Kong

(10) Patent No.: US 6,874,266 B1
(45) Date of Patent: Apr. 5, 2005

(54) INSERT FOR STORING A FIREARM CARTRIDGE WITHIN CAVITY OF HANDGUN GRIP

(76) Inventor: Larry Shuming Kong, 13305 Meyer Rd., Unit C, Whittier, CA (US) 90605

( * ) Notice: Subject to any disclaimer, the term of this patent is extended or adjusted under 35 U.S.C. 154(b) by 0 days.

(21) Appl. No.: 10/724,643

(22) Filed: Dec. 1, 2003

(51) Int. Cl.[7] ..... F41C 23/00

(52) U.S. Cl. ..... 42/71.01; 42/71.02; 42/7; 42/72; 89/34; 89/33.1

(58) Field of Search ..... 42/7, 49.01, 49.02, 42/50, 71.01–71.02, 1.02, 72; 89/34, 33.1

(56) References Cited

U.S. PATENT DOCUMENTS

| | | | | | |
|---|---|---|---|---|---|
| 1,129,884 | A | * | 3/1915 | Mauser | 42/50 |
| 4,798,018 | A | * | 1/1989 | Johansson | 42/7 |
| 5,052,140 | A | * | 10/1991 | Smith | 42/7 |
| 5,159,136 | A | * | 10/1992 | Marsh | 42/71.02 |
| 5,666,752 | A | * | 9/1997 | Grams | |
| 6,389,729 | B2 | * | 5/2002 | Rauch et al. | 42/71.01 |
| 6,536,152 | B1 | * | 3/2003 | Wisz | 42/71.02 |

OTHER PUBLICATIONS www.jentraplug.com*

* cited by examiner

*Primary Examiner*—Jack Keith
*Assistant Examiner*—L. Semunegus

(57) ABSTRACT

A device to provide storage of a firearm cartridge (26) within a firearm frame cavity (30) consisting of an insert body (10) shaped to fit within the frame cavity of the firearm while securely holding the firearm cartridge. The insert body contains a pair of rigid poles (12,14) attached to a pair of half disks (32,34) that secure the inserted cartridge by tensions created due to the rigidity of the poles when the inserted firearm cartridge forces the poles to their proximal positions. During insertion to the firearm frame cavity, the rigid stopper support (44) of the insert body is urged to its proximal position, but returns to its distal position when the stopper (18) engages the lanyard hole (48) of the frame cavity. Applying a downward force to the front bottom edge (24) of the insert body forces the rigid stopper support back to its proximal position and disengages the stopper from the lanyard hole facilitating removal of the insert body with the stored firearm cartridge still attached. Inspection hole (60) provides a visual check of the stored cartridge's presence while the insert body is within the firearm cavity (30).

1 Claim, 8 Drawing Sheets

INSERT FOR STORING A FIREARM CARTRIDGE WITHIN CAVITY OF HANDGUN GRIP

CROSS-REFERENCE TO RELATED APPLICATIONS

Not applicable

FEDERALLY SPONSORED RESEARCH

Not Applicable

BACKGROUND OF INVENTION

1. Field of Invention

This invention relates to firearms, specifically to a cavity insert used to store a round of ammunition within the grip cavity of a handgun.

2. Description of Prior Art

Several semi-automatic handguns, including those manufactured by Glock, contain small frame cavities near their magazine compartments. These frame cavities were designed to secure one end of a firearm lanyard or similar retention device. To date, inserts have been designed to prevent dust and debris from accumulating within this frame cavity. However, these inserts were not designed for storage nor can they be removed without tools. Other inserts have been designed specifically for the storage of firearm disassembly tools. No grip cavity inserts have been designed to store a caliber-specific round of ammunition that can be easily accessed when needed.

U.S. Pat. No. 5,159,136 issued Oct. 27, 1992 to Brett A. Marsh disclosed a handgrip-mounted cartridge clip having an elliptical cross-section. Said clip is used within a completely hollowed-out handgrip of a rifle or revolver, and not for the much smaller handgrip cavity near the magazine compartment of a semi-automatic handgun like those manufactured by Glock.

U.S. Pat. No. 6,389,729 issued May 21, 2002 to R. Water Rauch disclosed a device for storing and transporting firearm disassembly tools within a handgrip cavity. This device was specifically designed for the storage of disassembly tools and is not intended for, and sizing limitations prevent, the secure storage of a firearm cartridge. Additionally, the removal of this device requires an object or tool having an outside diameter of less than 4.5 mm to apply pressure to a plunger through the firearm lanyard hole. No disclosure exists for removing this device by hand.

SUMMARY INCLUDING OBJECTS AND ADVANTAGES

The present invention is a device for use with firearms. It is intended for use as an insert for storing a caliber-specific round of ammunition within the handgrip cavity of a conventional firearm such as a handgun manufactured by Glock. The invention is comprised of a single shaped insert body that will precisely fill the frame cavity of a handgun and securely store a single round of ammunition matching the caliber of the said handgun. The body will be latched in place by precise shape and sizing as well as the use of the lanyard hole within the frame cavity of the handgun. The cartridge receptacle hole within the body is positioned precisely to allow the body with cartridge to be inserted in the handgun cavity. A cavity above the front bottom edge of the insert body will protrude from the handgun cavity to which pressure can be applied with a fingernail or tool, to remove the insert with cartridge.

OBJECTS AND ADVANTAGES

Objects and advantages of my invention are to provide an insert that will safely and securely store an extra round of firearm ammunition within the handgun frame, and allow the user to conveniently engage and remove this insert without the need of additional tools. The plastics used to create this insert make it lightweight, durable, economical and allow the precise shaping and sizing required to keep the insert secure during field use, but also allow the user to remove the insert by hand without the use of additional tools. As with other inserts, this insert protects the handgun cavity from potentially harmful debris, enhances the ease of magazine insertion, and increases the overall handgun aesthetics. Further advantages can be seen in the ensuing description and accompanying drawings.

REFERENCE NUMERALS

| | |
|---|---|
| 10 insert body | 12 left pole |
| 14 right pole | 16 rear wall groove |
| 18 dome shaped stopper | 20 magazine guide |
| 22 thumbnail cavity | 24 front bottom edge |
| 26 inserted catridge | 28 rear bottom edge |
| 30 frame cavity | 32 left half disk |
| 34 right half disk | 36 cartridge receptacle hole |
| 38 rear edge of frame wall | 40 front edge of frame wall |
| 42 gap between cartridge hole & support | 44 stopper support |
| 46 bottom of cartridge hole | 48 lanyard hole |
| 50 left front wall of body | 52 right front wall of body |
| 54 rear wall of body | 56 gap between left wall & support |
| 58 gap between right wall & support | 60 inspection hole |
| 62 left base for left pole | 64 right base for right pole |

DETAILED DESCRIPTION OF PREFERRED EMBODIMENT(S)

Figure 1:
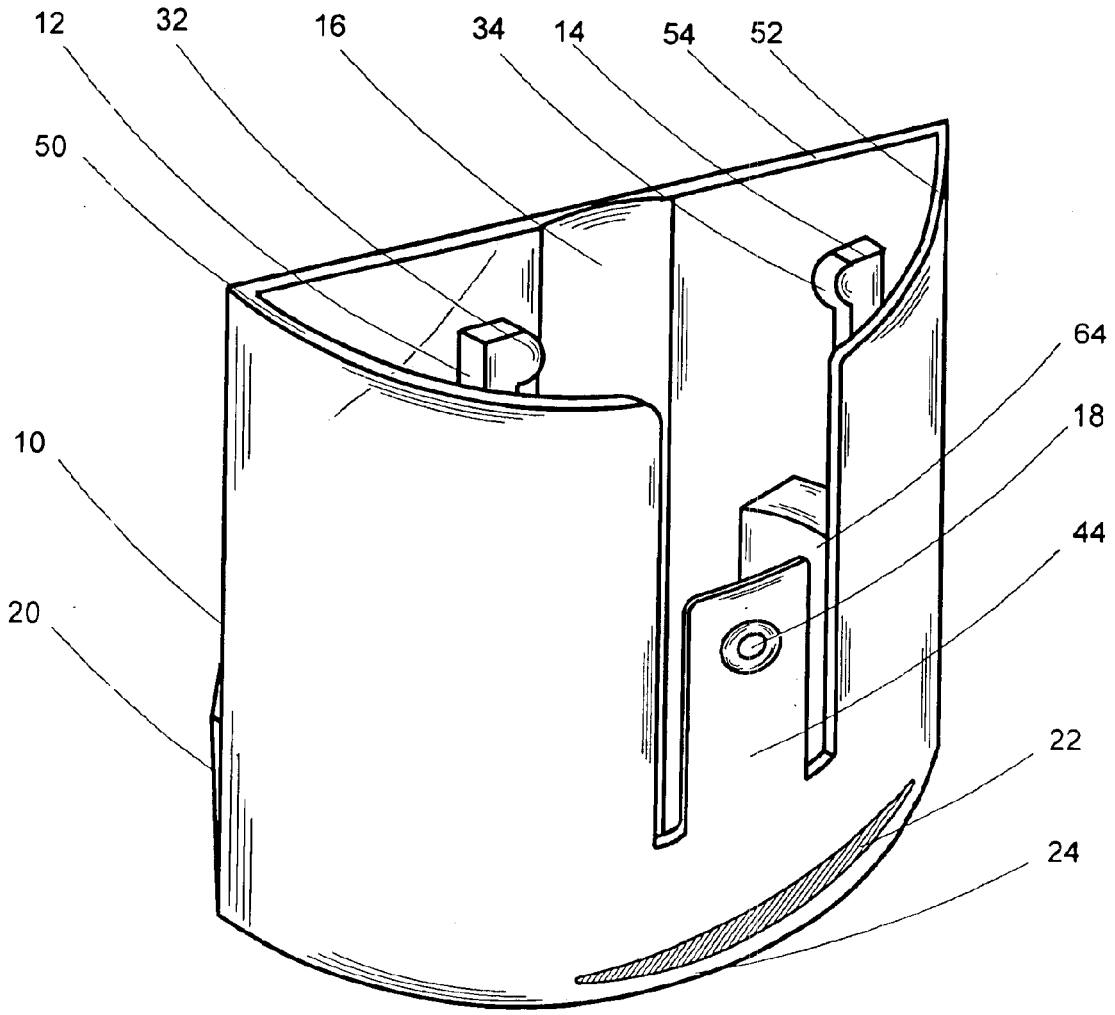
FIG. 1 is a right front perspective view of invention.

FIG. 1 is a right front perspective of the invention according to its preferred embodiment. This figure includes all visible features: insert body 10, left pole 12, right pole 14, rear wall groove 16, dome shaped stopper 18, magazine guide 20, thumbnail cavity 22, front bottom edge 24, left half disk 32, right half disk 34, left front wall 50, right front wall 52, rear wall 54, stopper support 44 and right base 64 for right pole 14. The dome top of stopper 18 has been flattened.

Figure 2:
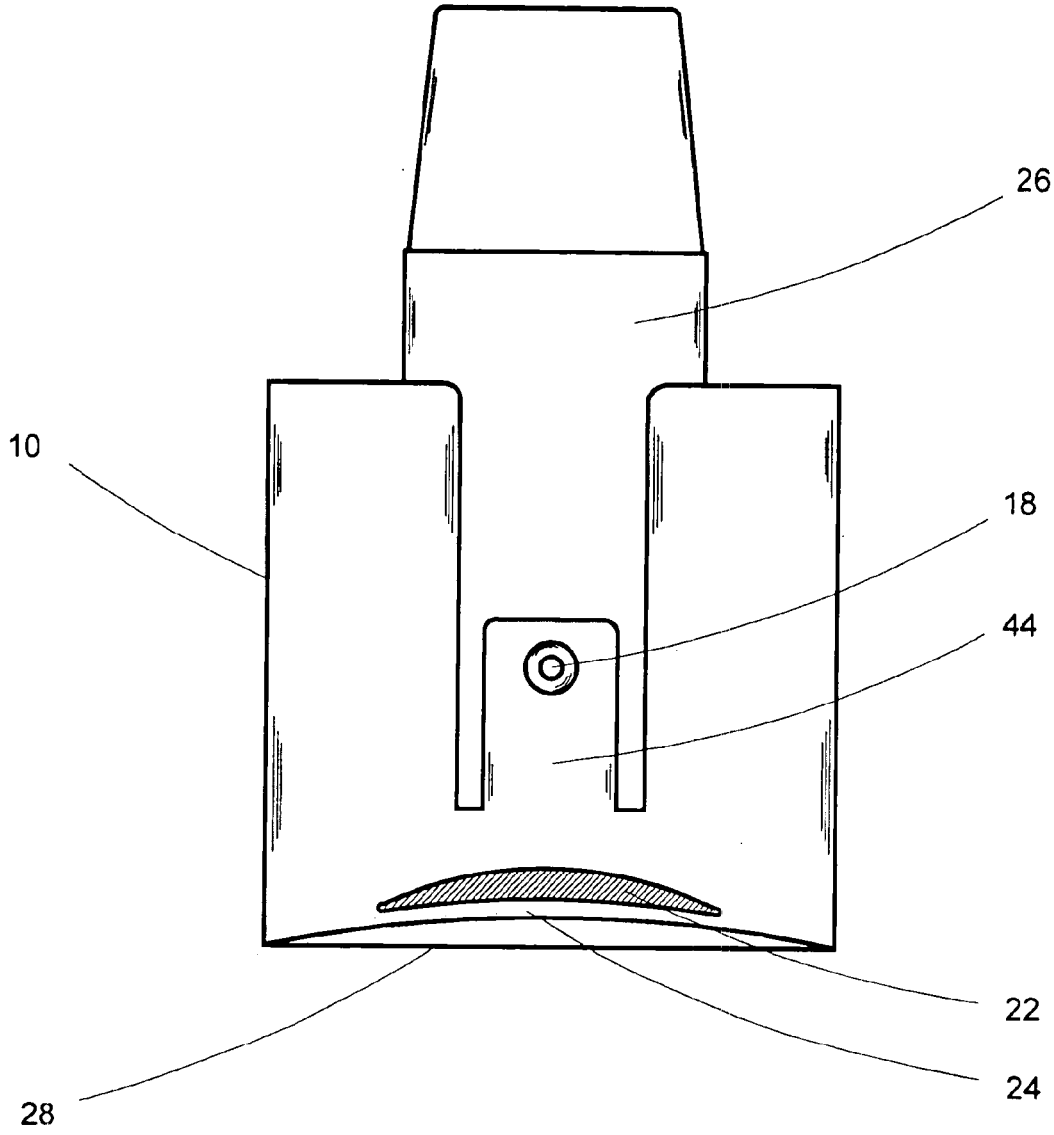
FIG. 2 is a front elevation view of invention with cartridge stored.

FIG. 2 is a front elevation view of the invention showing the handgun cartridge 26 stored in the insert body 10. The figure includes insert body 10, stopper 18, thumbnail cavity 22, front bottom edge 24, inserted cartridge 26, rear bottom edge 28, stopper support 44.

Figure 3A:
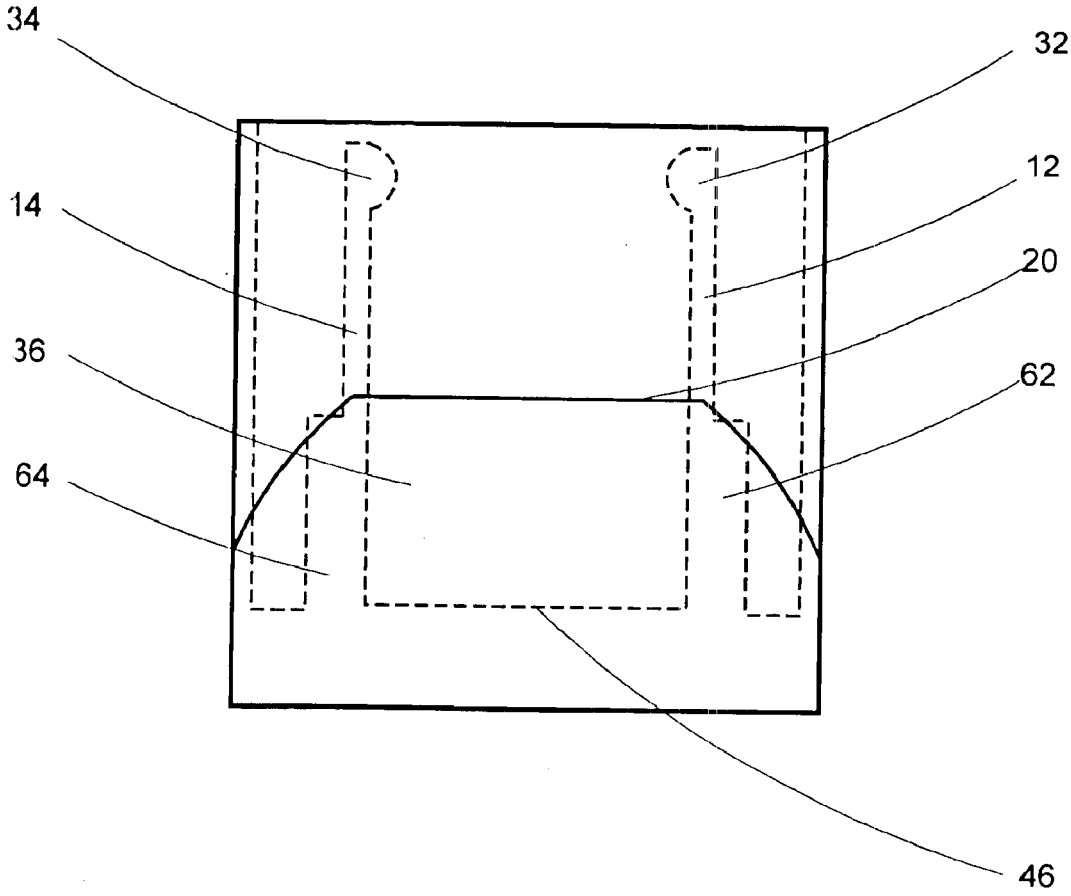
FIG. 3A is a rear elevation view of invention.

FIG. 3A is a rear elevation view of the invention showing the relationship of left pole 12, right pole 14, magazine guide 20, left half disk 32, right half disk 34, cartridge receptacle hole 36, left base 62 for left pole 12 and right base 64 for right pole 14.

Figure 3B:
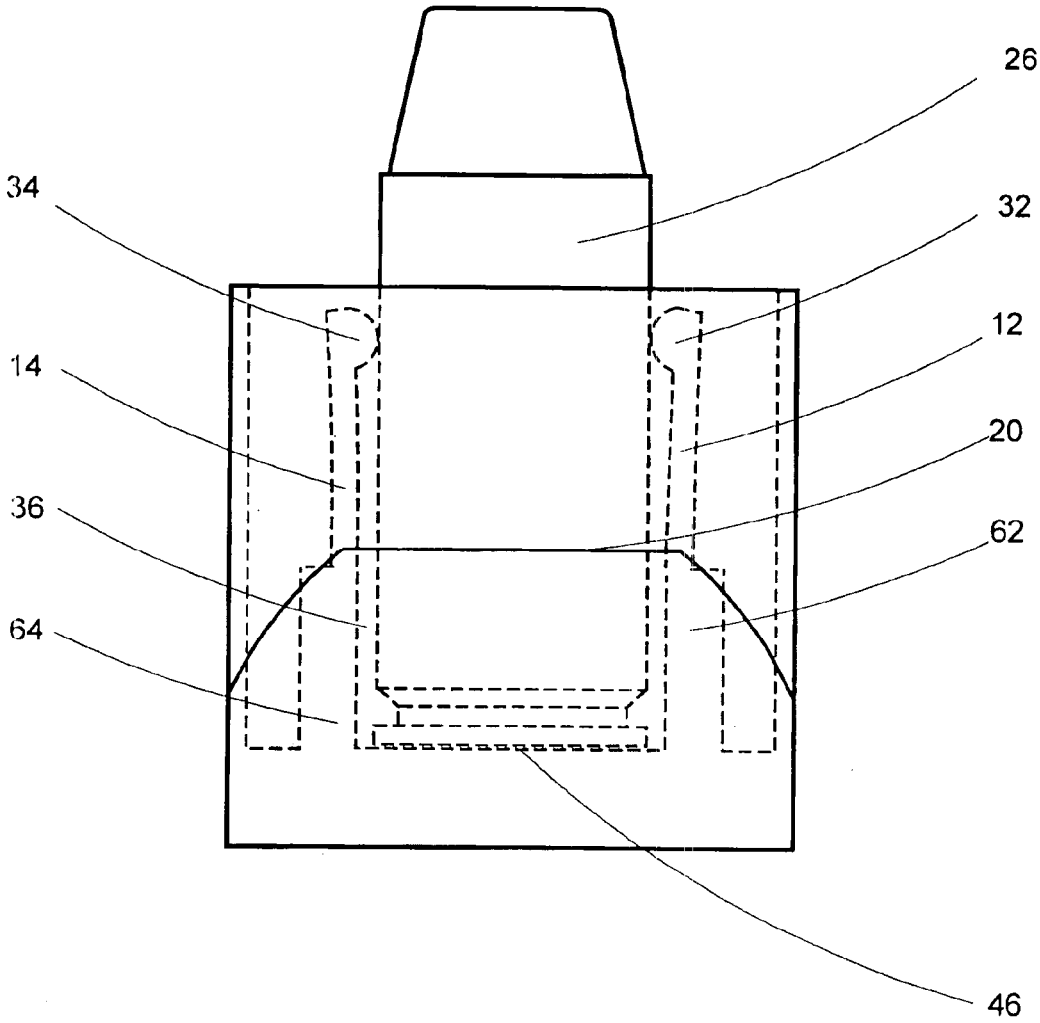
FIG. 3B is a rear elevation view of invention with 380 ACP (9 mm short) cartridge stored.

FIG. 3B is a rear elevation view of the invention showing the relationship of left pole 12, right pole 14, magazine guide 20, inserted 380 ACP (9 mm short) cartridge 26, left half disk 32, right half disk 34, cartridge receptacle hole 36 and the gap between cartridge 26 and the wall of receptacle hole 36, the bottom 46 of cartridge receptacle hole 36, left base 62 for left pole 12 and right base 64 for right pole 14.

Figure 3C:
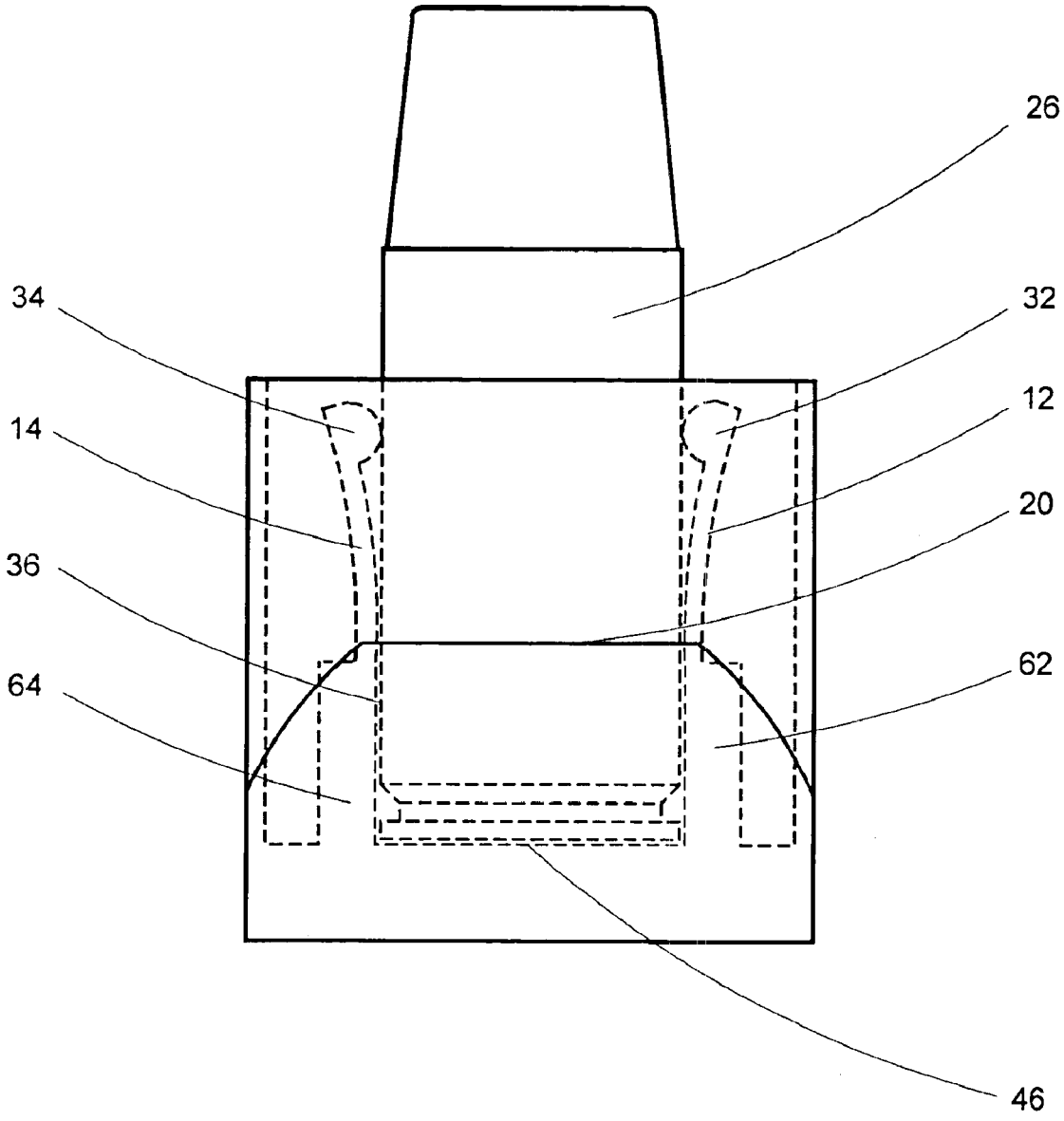
FIG. 3C is a rear elevation view of invention with 10 mm Automatic cartridge stored.

FIG. 3C is a rear elevation view of the invention showing the relationship of left pole 12, right pole 14, magazine guide 20, inserted 10 mm Automatic cartridge 26, left half disk 32, right half disk 34, cartridge receptacle hole 36 and the gap between cartridge 26 and the wall of receptacle hole 36 and the bottom 46 of the cartridge receptacle hole 36, left base 62 for left pole 12 and right base 64 for right pole 14.

Figure 4:
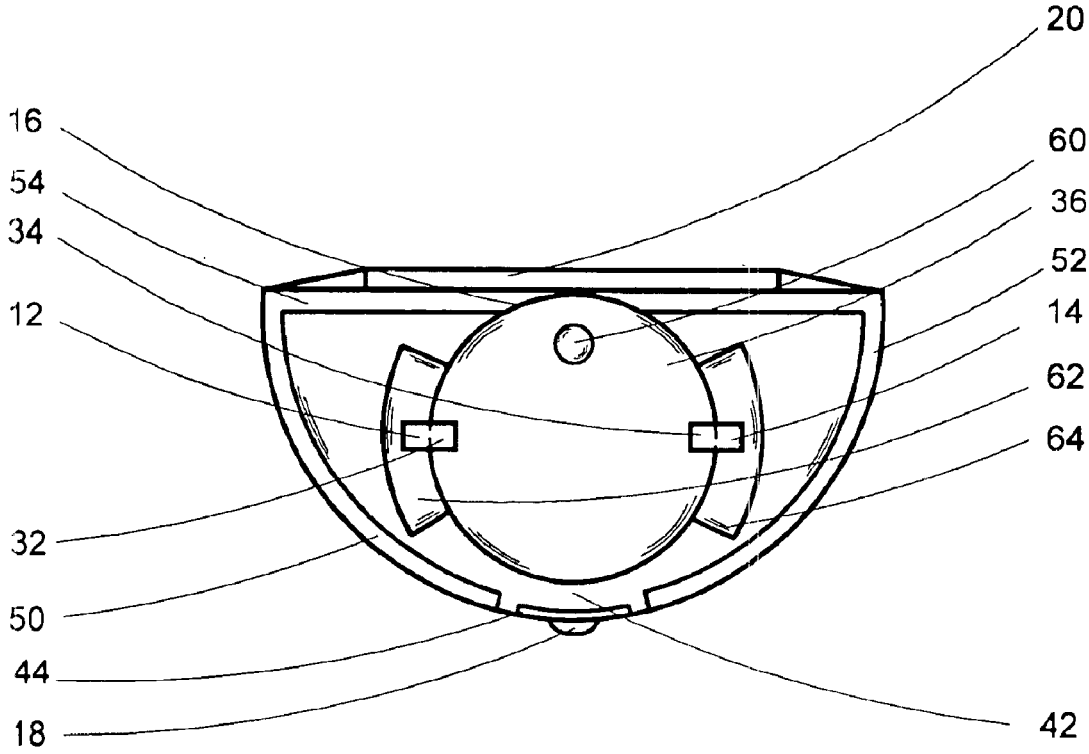
FIG. 4 is a top view of invention.

FIG. 4 is a top view of the invention showing the relationship of left pole 12, right pole 14, rear wall groove 16, dome shaped stopper 18, magazine guide 20, left half disk 32, right half disk 34, cartridge receptacle hole 36, left front wall 50, right front wall 52, inspection hole 60, left base 62, right base 64 and gap 42 between cartridge 26 and the rear wall 54 of stopper support 44.

Figure 5:
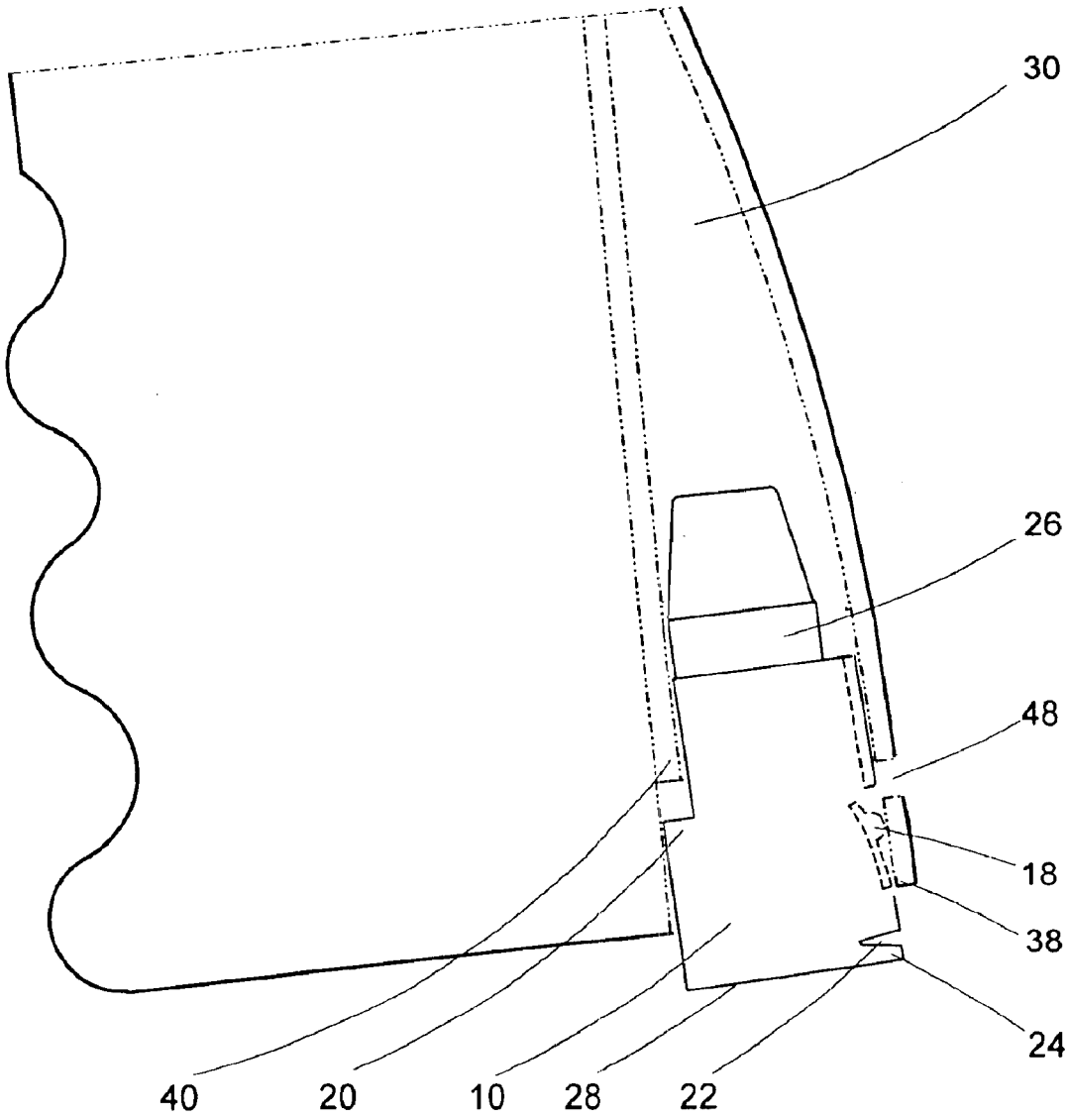
FIG. 5 is a right elevation view of the invention being inserted into the handgun cavity before the stopper reaches the lanyard hole. At this point, the stopper support bends inward.
Figure 6:
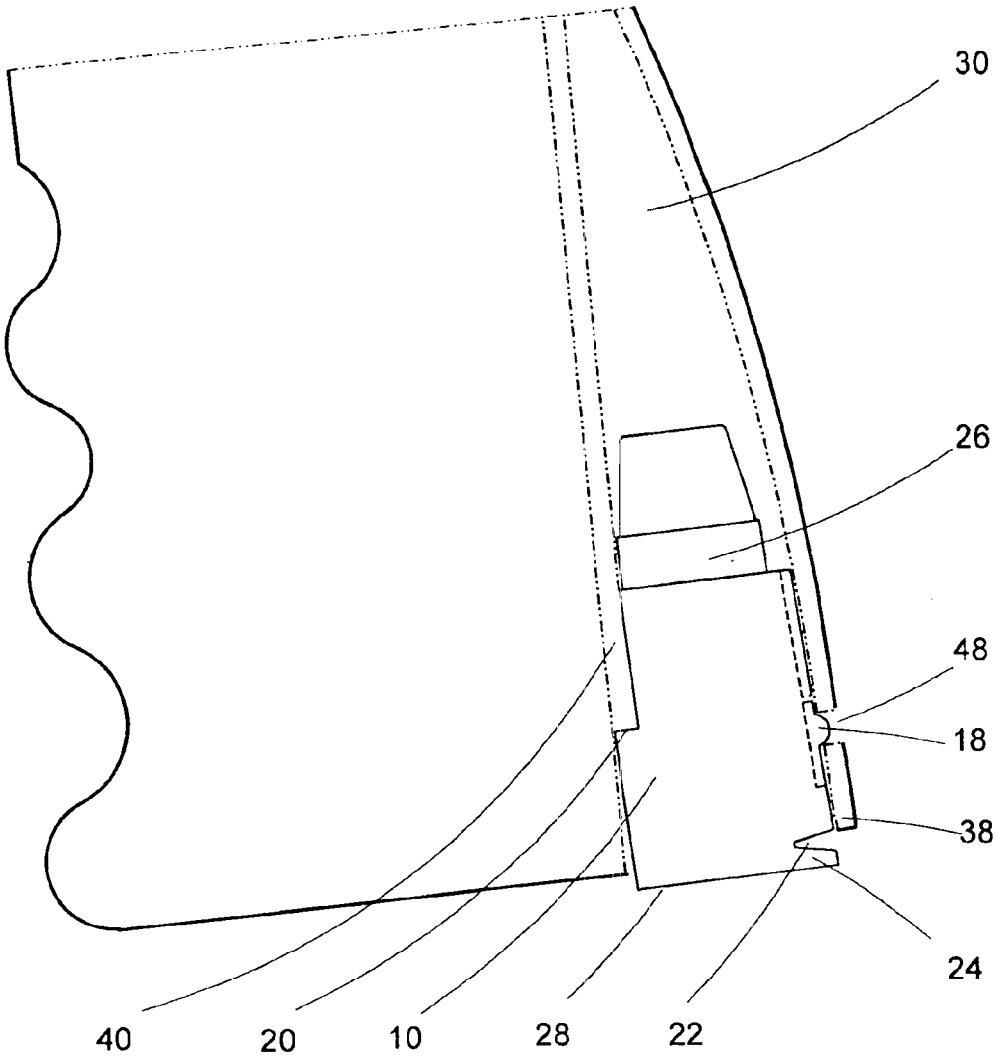
FIG. 6 is a right elevation view of the invention fully inserted into the handgun frame cavity. At this point, the stopper is engaged in the lanyard hole, and the stopper support is returned to its original position.

FIGS. 5 and 6 are right side elevation views of the invention with inserted cartridge during and after insertion into the frame cavity 30 of the firearm. FIG. 5 shows the shape of bent stopper 18 at the midway point of insertion prior to the stopper 18 reaching the lanyard hole 48. FIG. 6 shows the fully inserted invention in the frame cavity 30 of the handgun. The stopper support 44 has returned to its original position and the stopper 18 is engaged in the lanyard hole 48.

In accordance with the invention, the front of the insert body 10 (best shown in FIG. 1) is formed to create a shape matching the frame cavity 30. Thereafter, the bottom of insert body 10 is formed to approximate the design lines of frame cavity 30. The invention is made of thermoplastic material, created through the thermoforming process of injection molding. The cartridge holding system is comprised of left pole 12, left half disk 32, right pole 14, right half disk 34 and cartridge receptacle hole 36. The distance between convex edge of left half disk 12 and convex of right half disk is 8.6 mm (best shown in FIG. 3A). A cartridge (380 ACP, 9 mm Parabellum, 0.357 SIG, or 40 Smith & Wesson) will rest at the bottom 46 of cartridge hole 36 with poles 12 and 14 providing tensions through disks 32 and 34 which hold the cartridge in place above the cartridge midline (best shown in FIG. 3B and FIG. 3C). The largest cartridge, the 10 mm automatic (diameter 10.80 mm), bends poles 12 and 14, but space between these poles and the front walls 50 and 52 still exist (best shown in FIG. 3C).

The latching system of this invention is comprised of stopper 18, stopper support 44 and magazine guide 20. At the moment during insertion when stopper 18 reaches lanyard hole 48, stopper support 44 bends back to its original straight shape and stopper 18 engages lanyard hole 48. Also, the front edge of frame wall 40 blocks the magazine guide from further insertion. Thereafter, insert body 10 is securely latched in frame cavity 30 (best shown in FIG. 6). The inward bending of stopper support 44 is minimized by the flattened top of stopper 18 to prevent support 44 from contacting the cartridge during insertion. With the largest 10 mm Automatic cartridge (10.80 mm), stopper support 44 never comes in contact with the cartridge during the insertion process (shown in FIG. 4, FIG. 5).

The unlatching system of the invention is comprised of thumbnail cavity 22 and front bottom edge 24. Thumbnail cavity 22 is 14.80 mm in width, 2.40 mm in height at center, 0.20 mm in height at either end and 4.50 mm in depth at center. Downward force applied to front bottom edge 24 using a thumbnail or other tool inserted into cavity 22 will disengage stopper 18 from the firearm lanyard hole 48.

Inspection hole 60 is drilled at the bottom of insert body 10 to allow a user to verify the presence of a cartridge without removing insert body 10 and without detaching the magazine of the handgun (best shown in FIG. 4).

This embodiment of insert body 10 is thermoplastic polyurethane, colored black with detailed dimensions as follows: height of insert body —21.00 mm; width of body 10—21.15 mm thickness of the body 10 at top —12.40 mm; thickness of body 10 at bottom —13.90 mm; radius of the body 10 at top —12.40 mm; radius of the body at bottom —13.90 mm (best shown in FIG. 1); height of pole 12—9.35 mm; width of pole 12—2.20 mm; depth of pole 12—2.20 mm; diameter of half disk 32—3.00 mm; height of pole 14—9.35 mm; width of pole 14—2.20 mm; depth of pole 14—2.20 mm; diameter of half disk 34—3.00 mm (best shown in FIG. 3A); height of support 44—8.00 mm; width of support 44—5.00 mm; diameter of stopper 18—3.60 mm; left gap 56 between left front wall 52 and support 44—1.50 mm; right front wall 54 and support 44— 1.50 mm (best shown in FIG. 2); thickness of stopper 18—0.80 mm; thickness of support 44— 0.80 mm; thickness of left front wall 50—2.00 mm; thickness of right front wall 52—2.00 mm; thickness of rear wall 54—2.00 mm; diameter of cartridge receptacle hole 36—10.80 mm; height of left base 62 for left pole 12—7.25 mm; height of right base 64 for left pole 14—7.25 mm; thickness of left base 62—4.60 mm and thickness of right base 64—4.60 mm (best shown in FIG. 3A and FIG. 4); diameter of inspection hole 60—2.6 mm centered 4.00 mm from rear wall 20 (best shown in FIG. 4).

PREFERRED EMBODIMENT

Operation

Operation and use of the invention is simple and straightforward. To insert a cartridge into the invention body 10, simply place primer side of cartridge 26 facing downwards into the cartridge receptacle hole 36 until it rests at the bottom of hole 36. Poles 12 and 14 along with half disks 32 and 34 will provide tensions and frictions to hold the cartridge in place. In this manner, the cartridge can be easily inserted and extracted from the invention body. Note that the invention body must not be inserted into the handgun grip cavity while inserting or removing a cartridge from the invention body. With a stored cartridge, to insert body 10 into the frame cavity 30 of the handgun grip, orient the invention body such that stopper 18 of the invention is aligned with lanyard hole 48 of the grip cavity. Apply upward force to the invention until stopper support 44 straightens engaging stopper 18 to the lanyard hole. The front of the frame wall 40 blocks the magazine guide 20 from further insertion as well. To remove the invention from the frame cavity of the firearm grip, apply downward force to the front bottom edge 24 of body 10 by inserting a thumbnail or other object into cavity 22. Apply enough force to disengage stopper 18 from lanyard hole 48. Once stopper 18 and lanyard hole 48 are disengaged, withdraw the invention from the frame cavity 30.

CONCLUSION, RAMIFICATION AND SCOPE

An insert is provided that will securely store a firearm cartridge within a firearm grip cavity, and allow a user easy access to said cartridge. This insert is lightweight, economical, easy to fabricate, highly durable and does not alter the operation of the firearm in which it is inserted. The description above outline preferred embodiments of this invention and should not be construed as limiting the scope of said invention. Other embodiments and ramifications are possible within this invention's scope. For example, different caliber cartridges other than those described could be stored in this invention's insert body. Also, the shape and size of this invention could be modified to fit cavities of various other makes and models of firearms similar to those described by cavity 30.

I claim:

1. A firearm cartridge holding and storing device within cavity of firearm frame cavity, comprising: a rigid insert body of predetermined size and shape that precisely fits into said firearm frame cavity; a holding means on said insert body comprised of rigid poles and half disks of predetermined sizes to secure one of various sizes of firearm cartridges within said insert body; a latching mechanism comprised of a stopper and rigid stopper support of predetermined sizes to engage a lanyard hole of said firearm frame cavity and latch said insert, with or without a stored ammunition cartridge, within said frame cavity, an unlatching mechanism comprised of a front bottom edge of said insert to which a downward force can be applied to unlatch said stopper from said lanyard hole to facilitate removal of said insert body from said firearm cavity; said insert containing a cavity of predetermined size to expose more of said front bottom edge to allow insertion of a larger object for which to apply force to said front bottom edge; a viewing mechanism comprised of a viewing hole of predetermined size placed in a predetermined location of said insert body for a human to verify presence of said stored cartridge while said insert is latched into said firearm frame cavity.

* * * * *